US008632349B2

(12) United States Patent
Genta

(10) Patent No.: US 8,632,349 B2
(45) Date of Patent: Jan. 21, 2014

(54) ELECTRICAL CONNECTOR

(75) Inventor: Alessandro Genta, Turin (IT)

(73) Assignee: Tyco Electronics AMP Italia SRL, Turin (IT)

( * ) Notice: Subject to any disclaimer, the term of this patent is extended or adjusted under 35 U.S.C. 154(b) by 0 days.

(21) Appl. No.: 13/581,780

(22) PCT Filed: Feb. 28, 2011

(86) PCT No.: PCT/EP2011/052884

§ 371 (c)(1), (2), (4) Date: Aug. 29, 2012

(87) PCT Pub. No.: WO2011/107416

PCT Pub. Date: Sep. 9, 2011

(65) Prior Publication Data

US 2012/0329302 A1 Dec. 27, 2012

(30) Foreign Application Priority Data

Mar. 4, 2010 (IT) ..... TO2010A0162

(51) Int. Cl.
*H01R 13/62* (2006.01)

(52) U.S. Cl.
USPC ..... 439/157

(58) Field of Classification Search
USPC ..... 439/157, 347, 348
See application file for complete search history.

(56) References Cited

U.S. PATENT DOCUMENTS 5,110,301 A * 5/1992 Inoue et al. ..... 439/310
5,244,400 A 9/1993 Hatagishi
5,921,791 A * 7/1999 Ono et al. ..... 439/157
6,186,804 B1 * 2/2001 Smith et al. ..... 439/157
6,948,952 B2 * 9/2005 Hubbard et al. ..... 439/157

FOREIGN PATENT DOCUMENTS

EP 1005112 A2 5/2000

OTHER PUBLICATIONS

International Preliminary Report on Patentability issued by The International Bureau of WIPO, Geneva, Switzerland, dated Sep. 4, 2012 for related International Application No. PCT/EP2011/052884; 5 pages.
International Search Report and Written Opinion issued by the European Patent Office, dated Mar. 31, 2011 for related International Application No. PCT/EP2011/052884; 9 pages.

* cited by examiner

*Primary Examiner* — Briggitte R Hammond
(74) *Attorney, Agent, or Firm* — Faegre Baker Daniels LLP

(57) ABSTRACT

An electrical connector comprises a first connector element (2) and a second connector element (4) carrying respective contacts, and interconnected so as to be movable, along a coupling direction, between an uncoupled state and a coupled state. A sliding element (5) is mounted in the first connector element (2) so as to be slidable, in a direction orthogonal to said direction of coupling, between an extended position and a retracted position in the first connector element (2). The sliding element (5) has one or more cam tracks (5T), each engaged by an element (4P) of the second connector element (4) in such a way that a movement of the sliding element (5) from the extended position thereof to the retracted position thereof in said first connector element (2) causes the second connector element (4) to move into the coupled state. Each of said cam follower elements (4P) of the second connector element (4) engages the respective cam track (5T) via a cog (4W) mounted rotatably on said cam follower element (4P).

6 Claims, 10 Drawing Sheets

ELECTRICAL CONNECTOR

The present invention relates to electrical connectors of the type comprising a first connector element and a second connector element carrying respective contacts and interconnected so is to be movable, along a coupling direction, between an uncoupled state and a coupled state, the connector further comprising a sliding element mounted in the first connector element so as to be slidable, in a direction orthogonal to said direction of coupling, between an extended position and a retracted position in said first connector element, said sliding element having one or more cam tracks, each engaged by an element of said second connector element in such a way that a movement of the sliding element from the extended position thereof to the retracted position thereof in said first connector element causes the second connector element to move into the coupled state.

The object of the present invention is to provide a connector of the above-mentioned type in which the force which has to be applied to the sliding element in order to couple the two connector elements is substantially reduced compared to that required with known connectors of the above-mentioned type.

A further object of the invention is to provide a connector of the above-mentioned type which is no more complicated or expensive to produce compared to known connectors.

Yet a further object of the invention is to provide a connector which is compact in size.

With a view to achieving these and further objects, the invention relates to a connector having all the features indicated at the outset of the present description and further characterised in that each of said pins of the second connector element engages the respective cam track via a rolling element mounted rotatably on the pin.

As a result of the above feature, the sliding element and the pins of the second connector element are contacted with rolling friction instead of with sliding friction, which makes it possible to substantially reduce the force to be applied to the sliding element in order to close the connector.

In accordance with a further preferred feature, the surface of each rolling element and the cooperating surface of the respective cam track are knurled or toothed so as to avoid, or at least minimise the risk that the rolling element may slip on the track during the movement to close the connector. It is thus ensured that the movement of the rolling element is substantially a purely rolling movement.

Figure 1A:
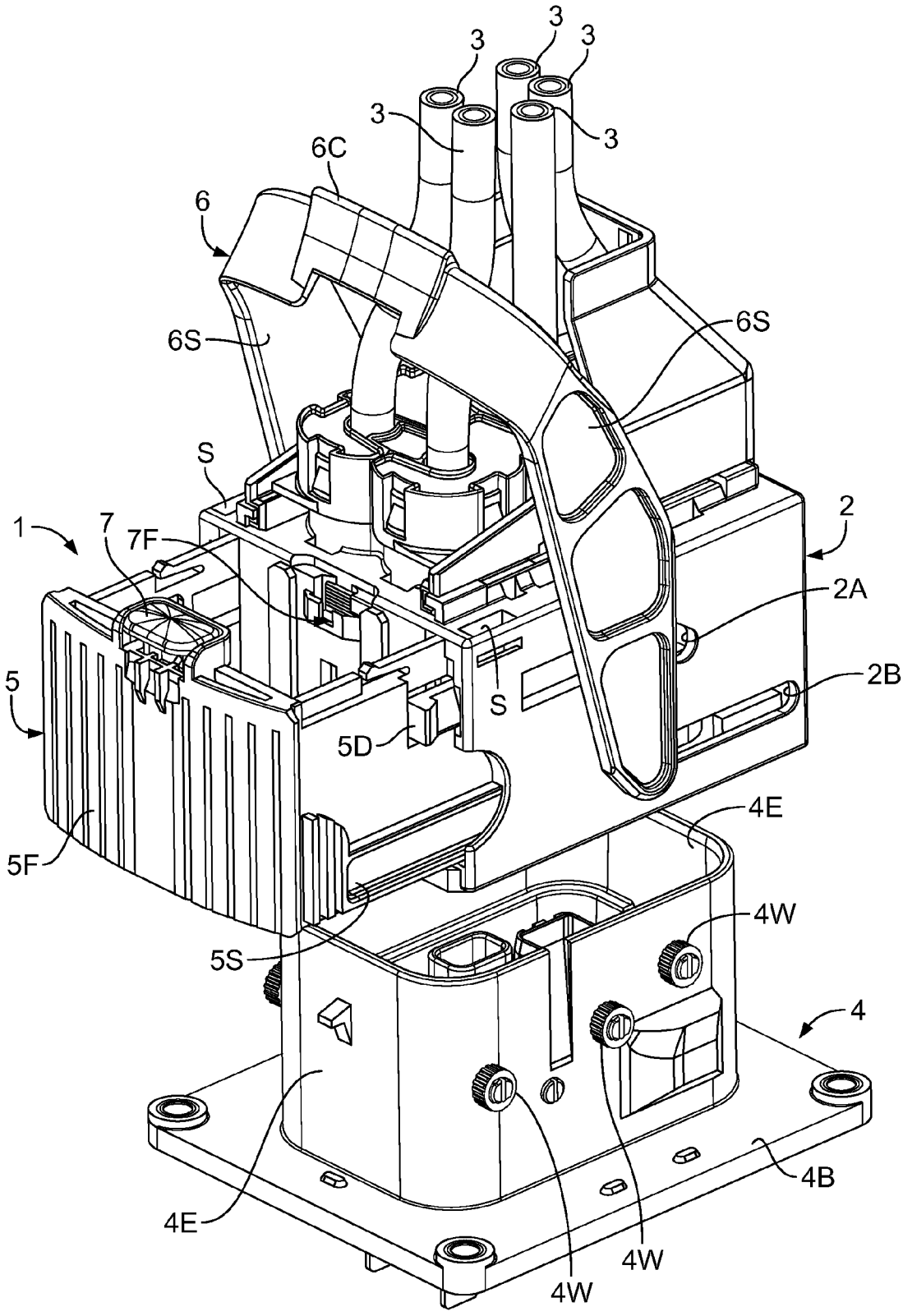
Figure 1B:
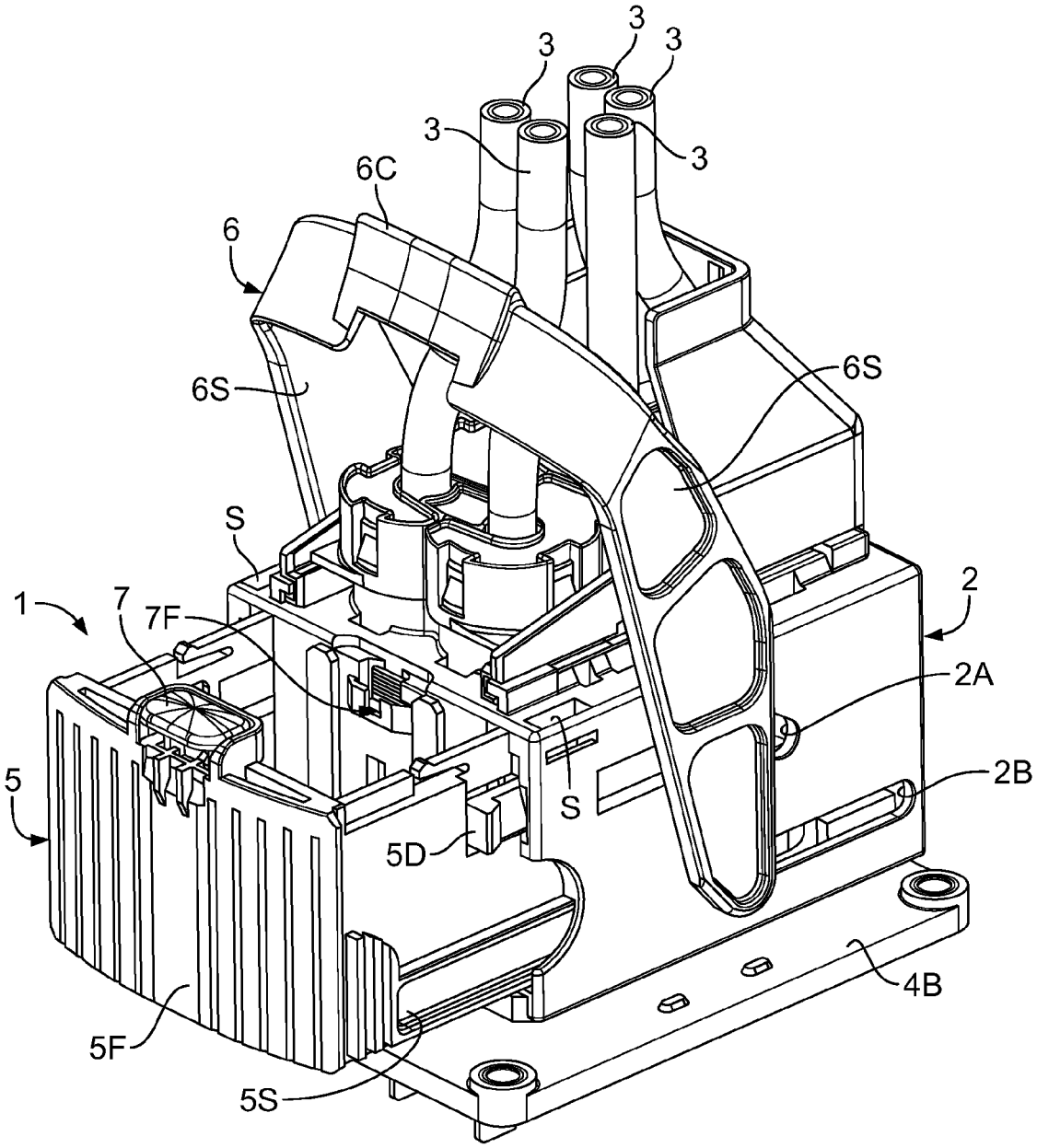
Figure 2:
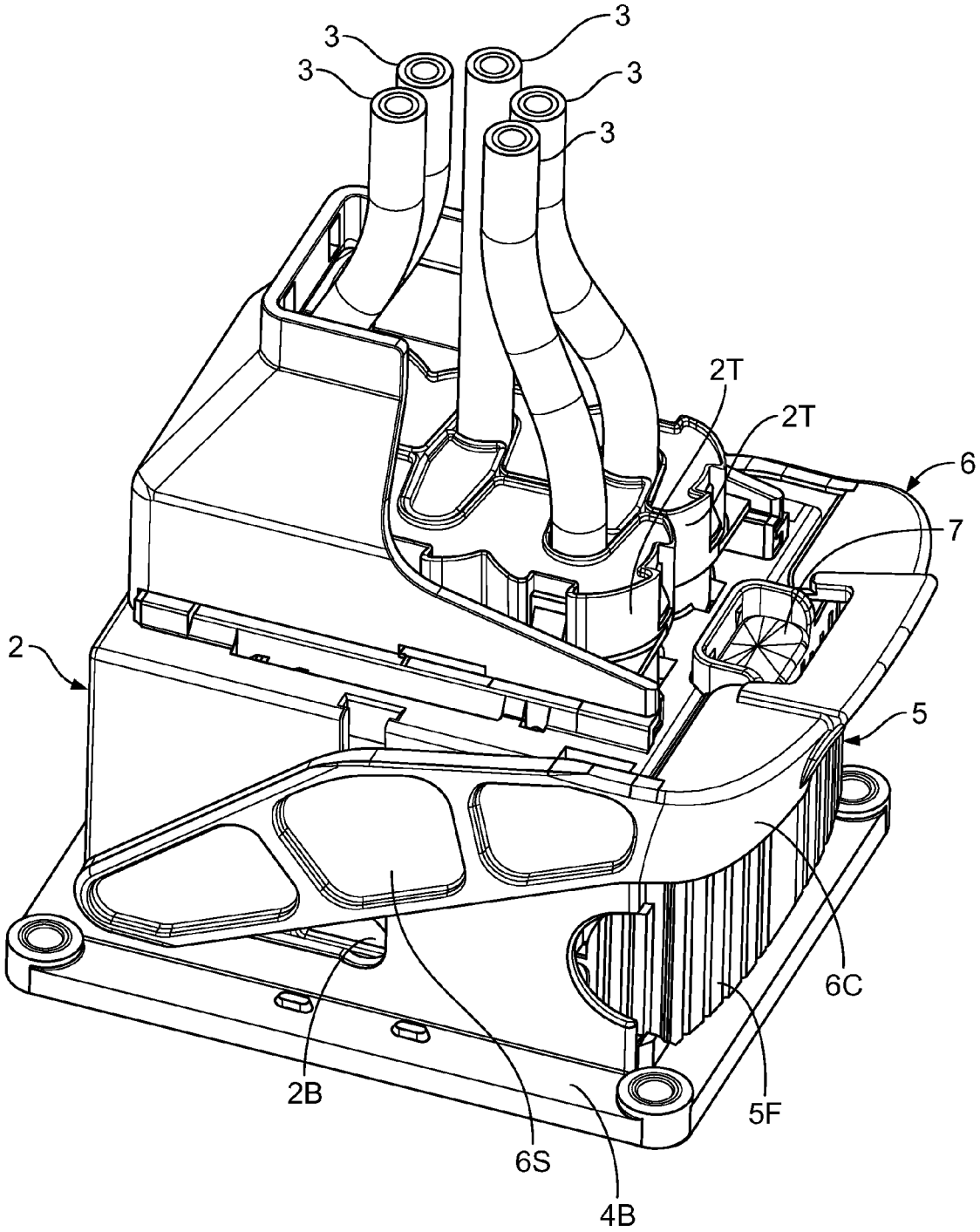
Figure 4:
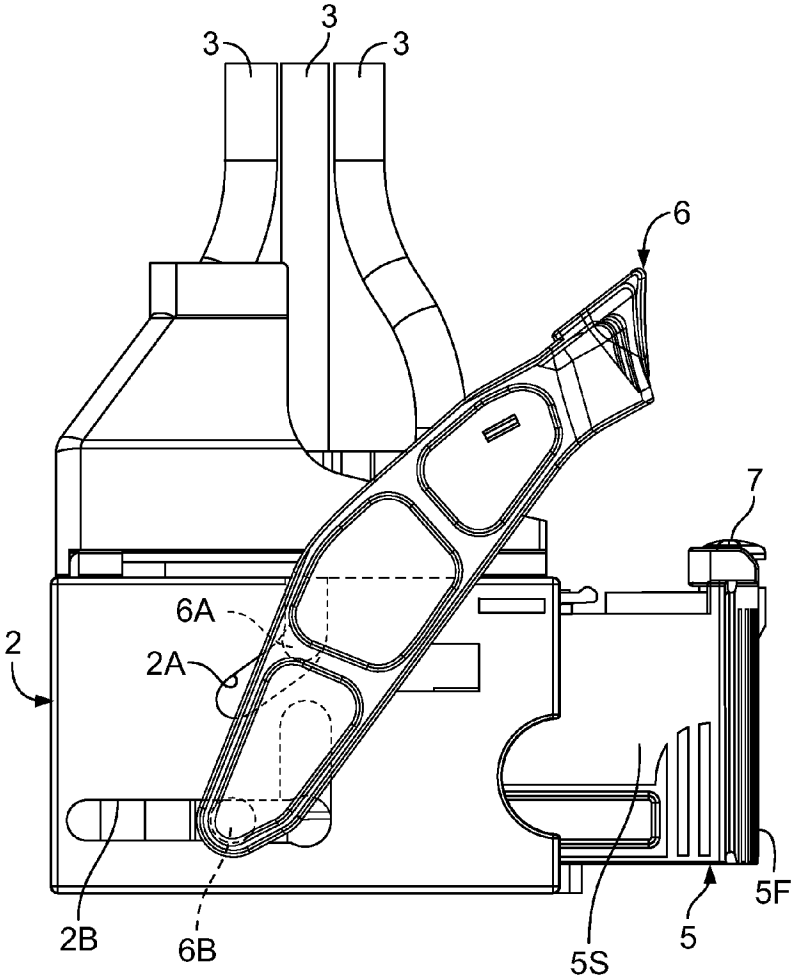
Figure 3:
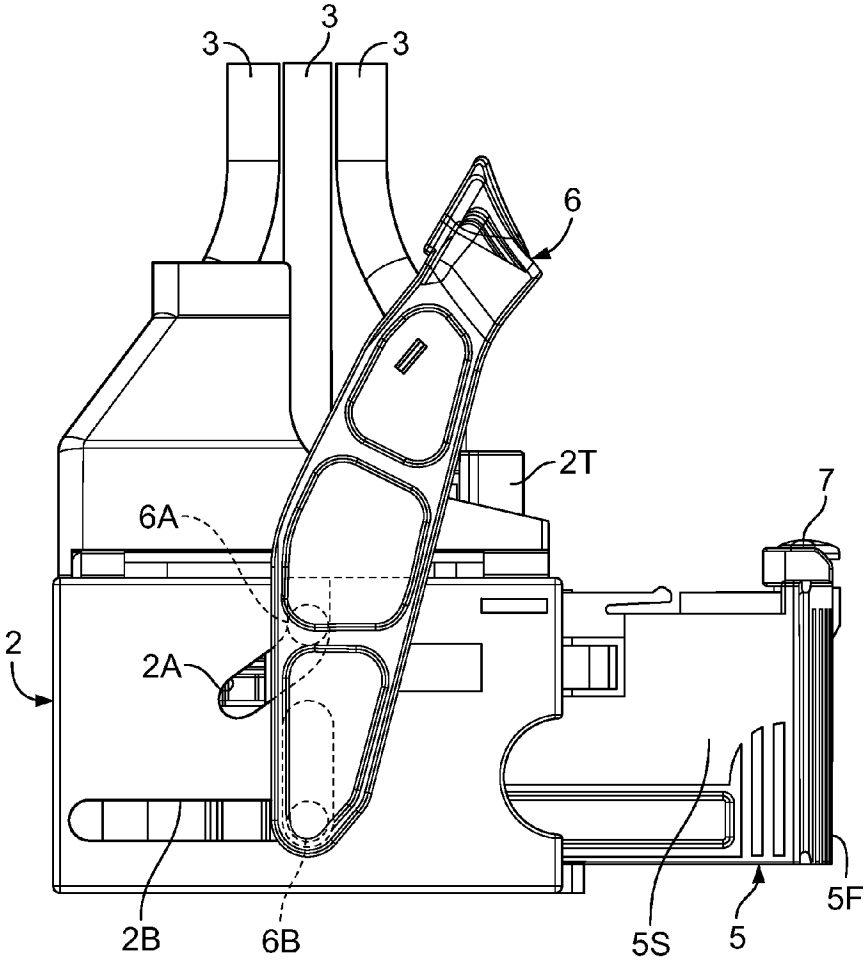
Figure 6:
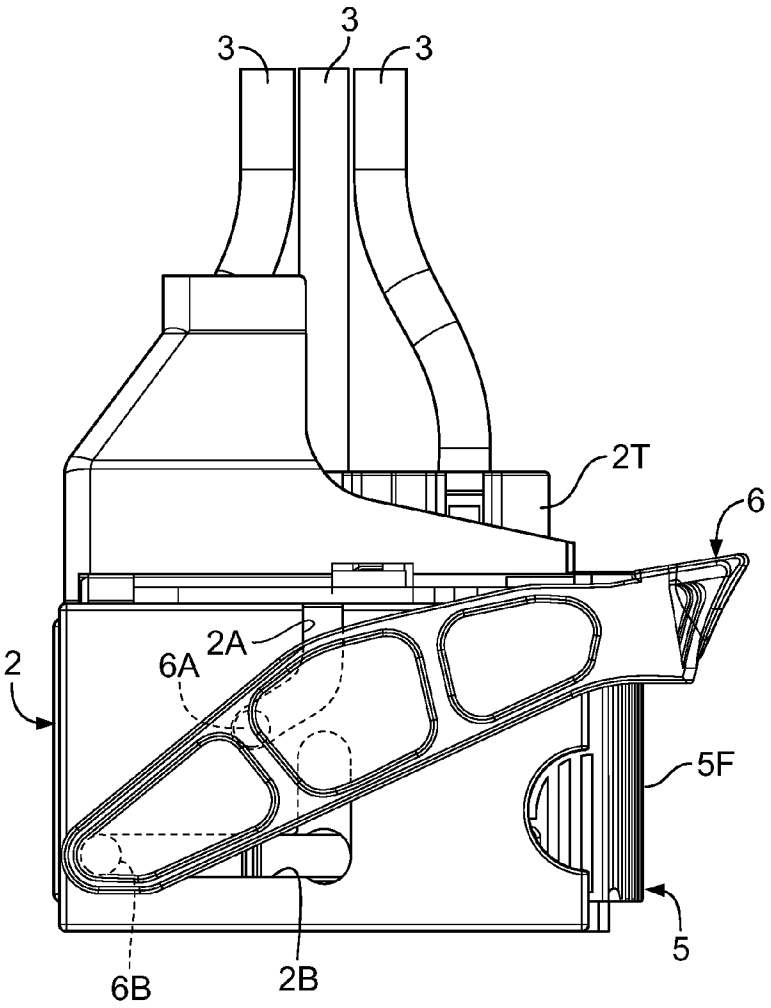
Figure 5:
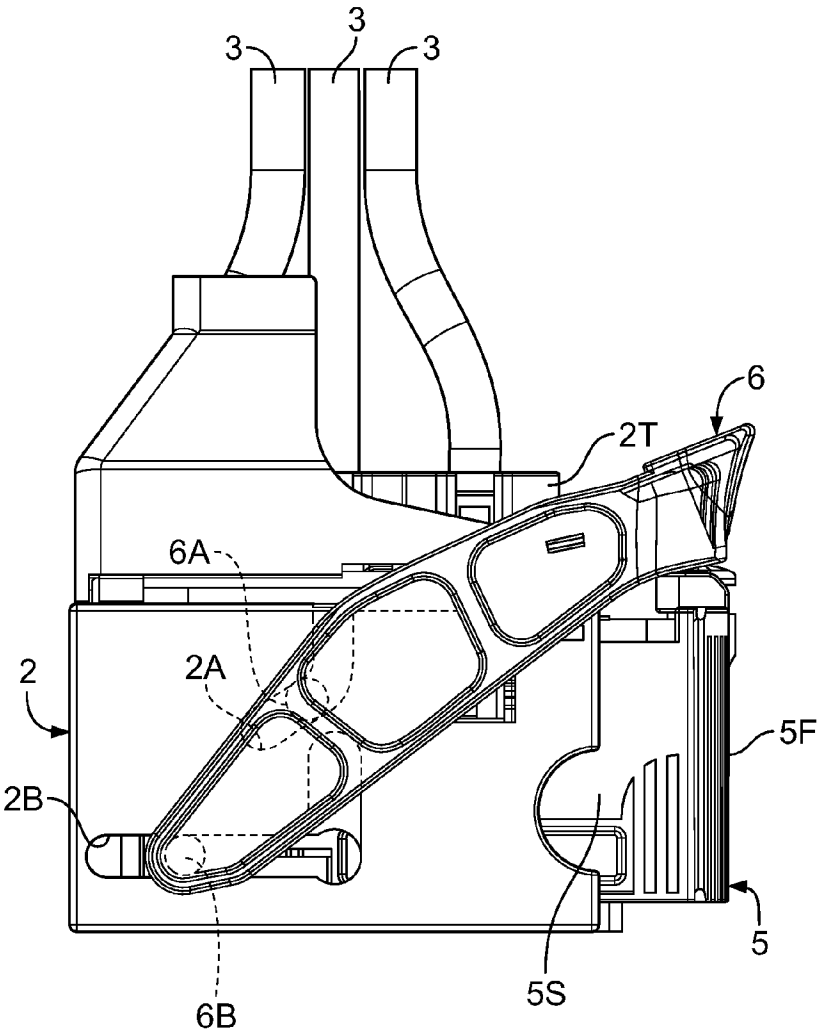
Figure 8:
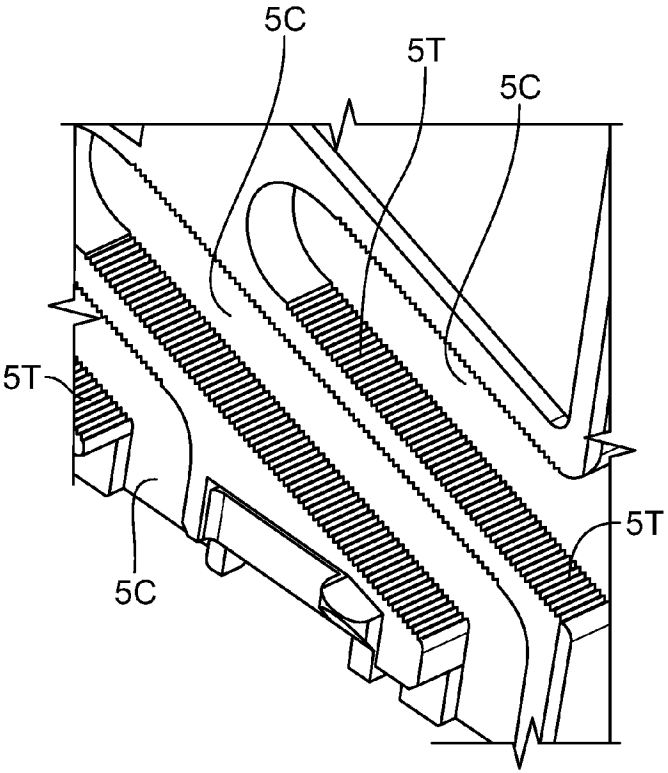
Figure 7:
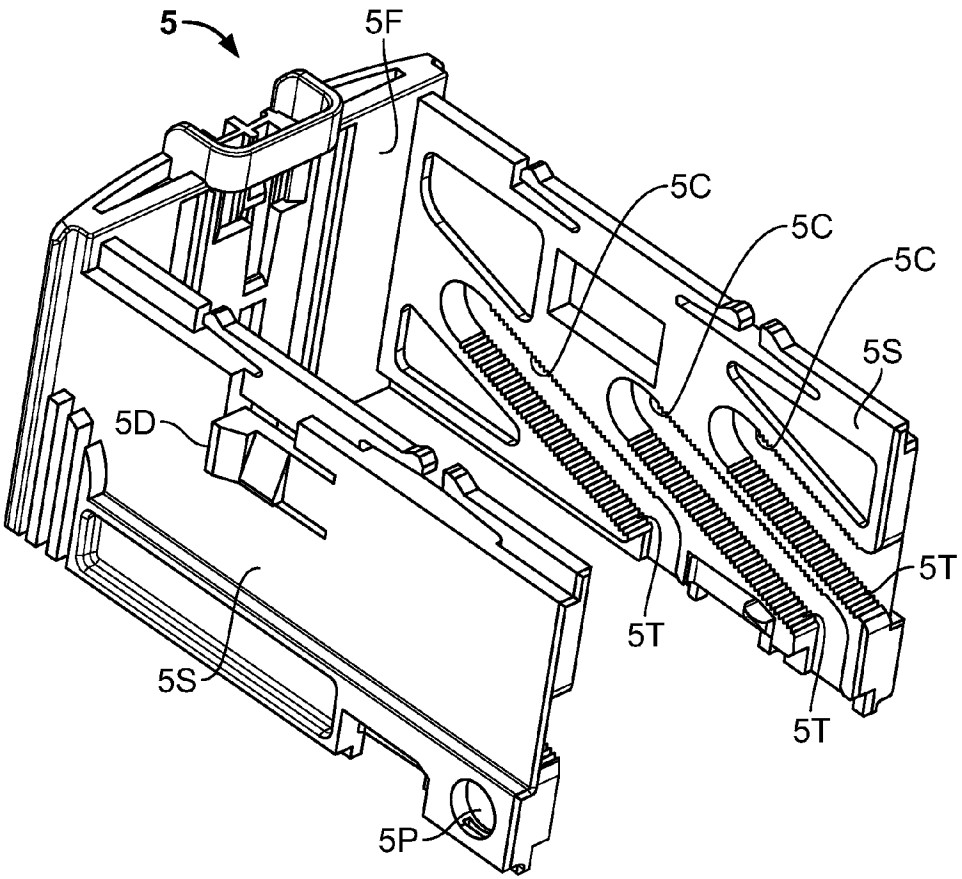
Figure 9:
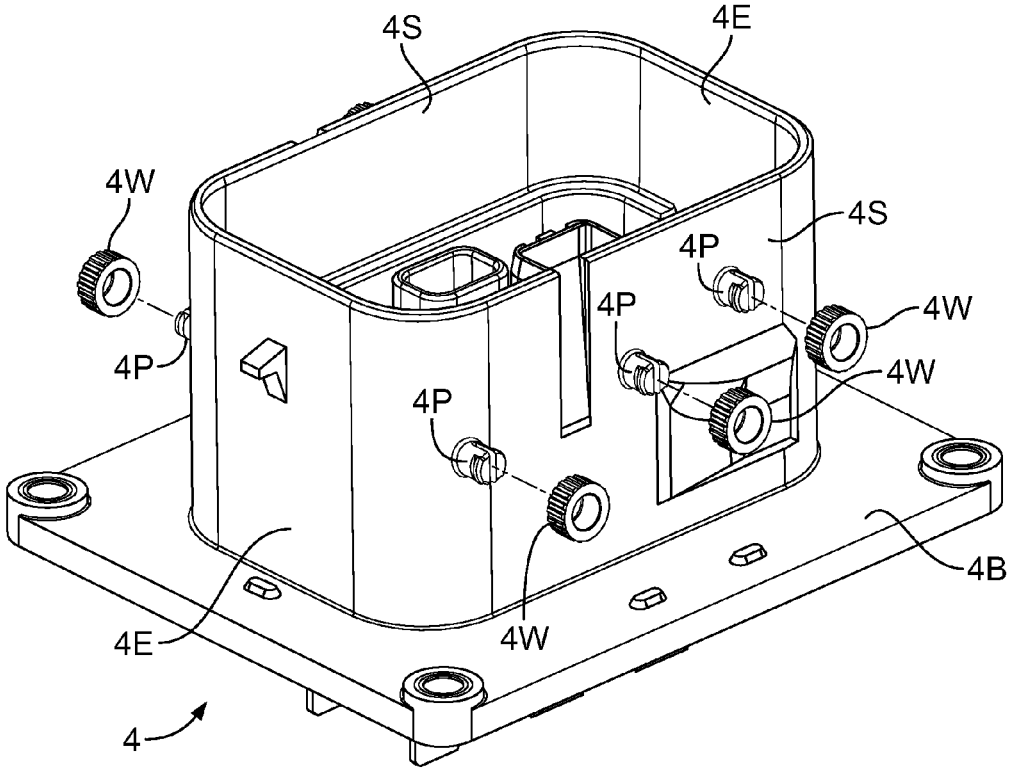
Figure 10:
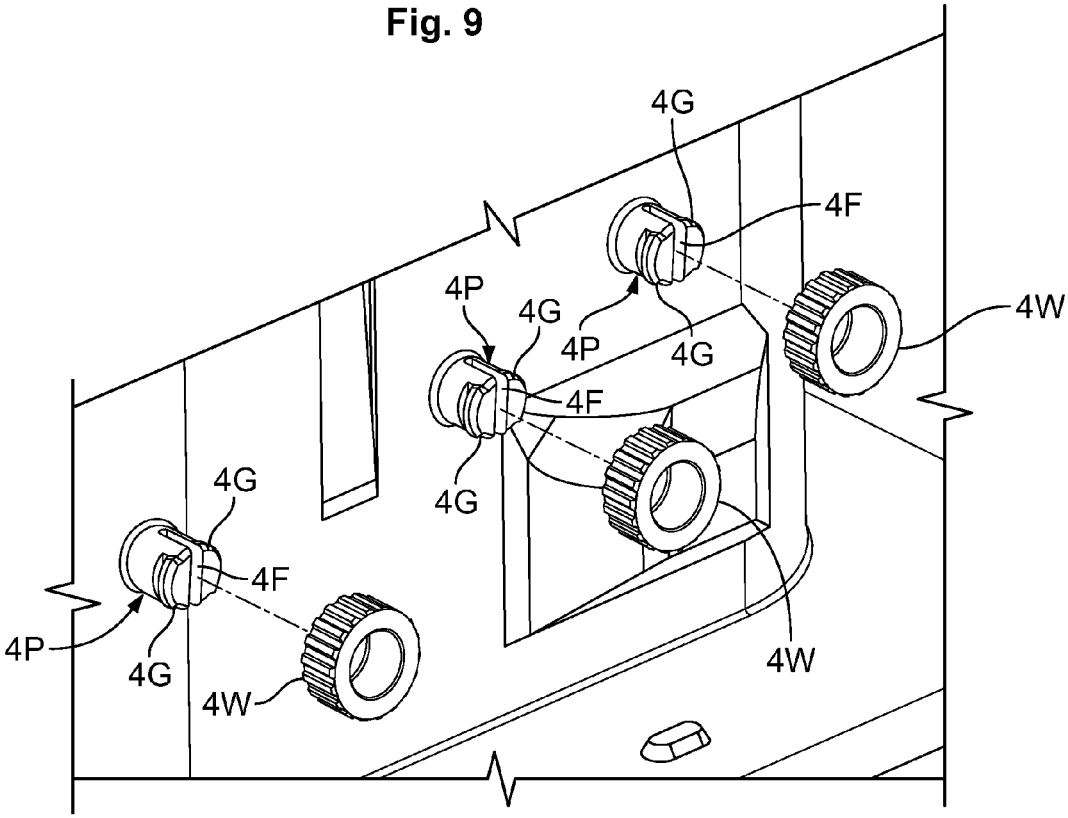
Figure 11B:
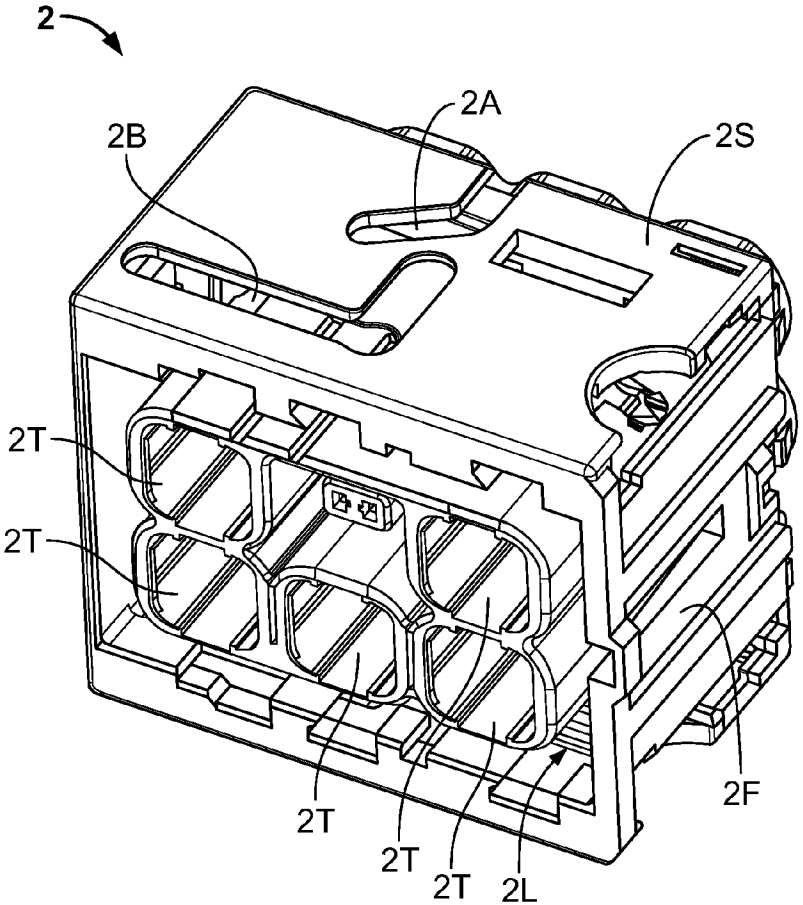
Figure 11A:
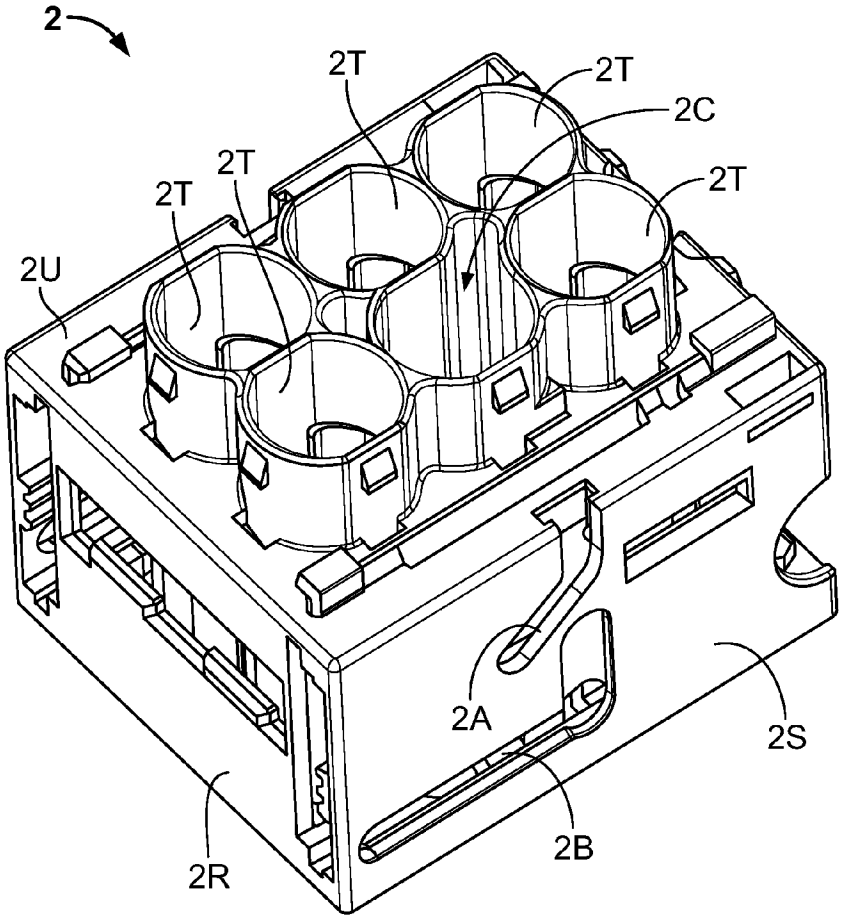
Figure 12:
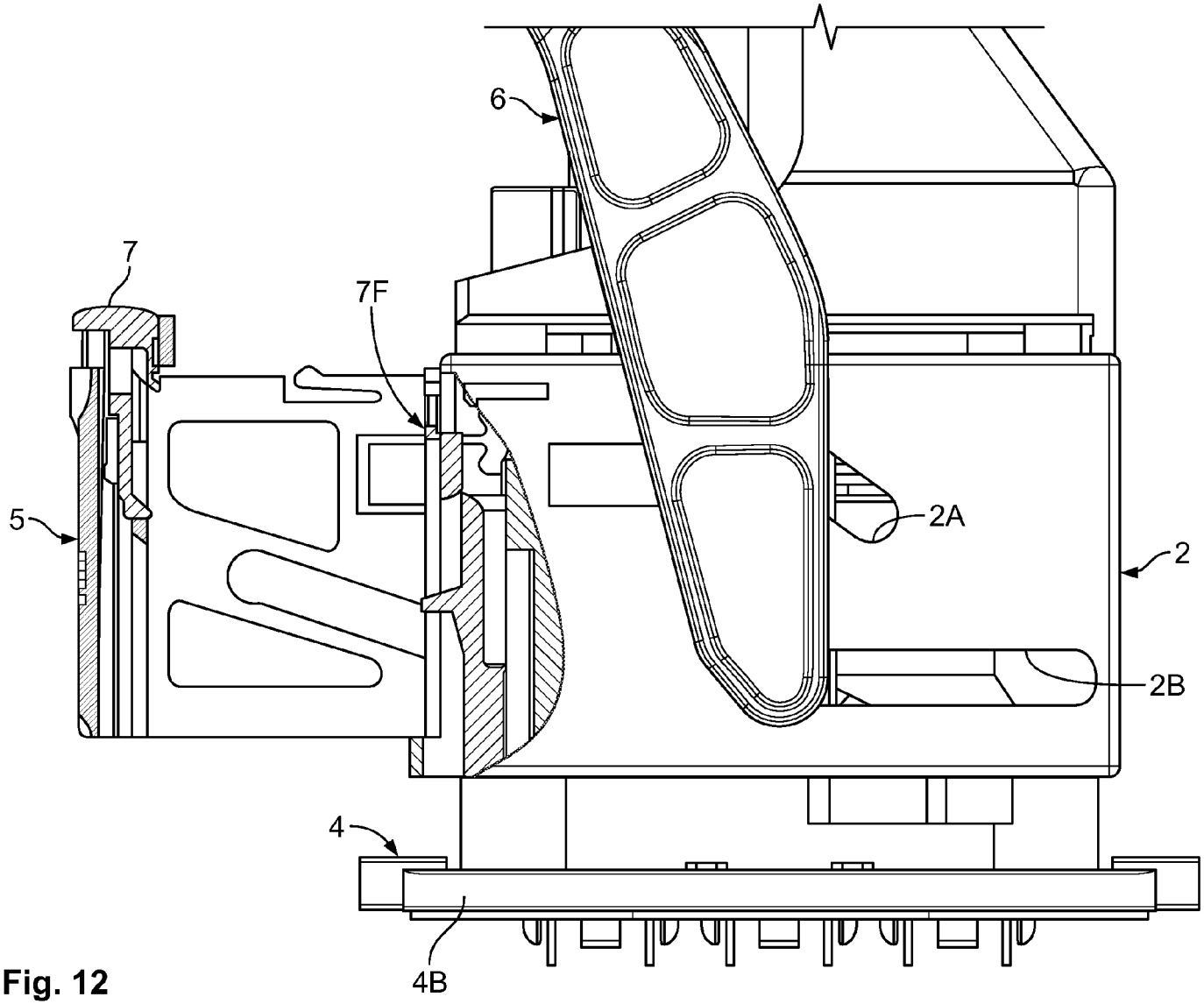
Figure 13:
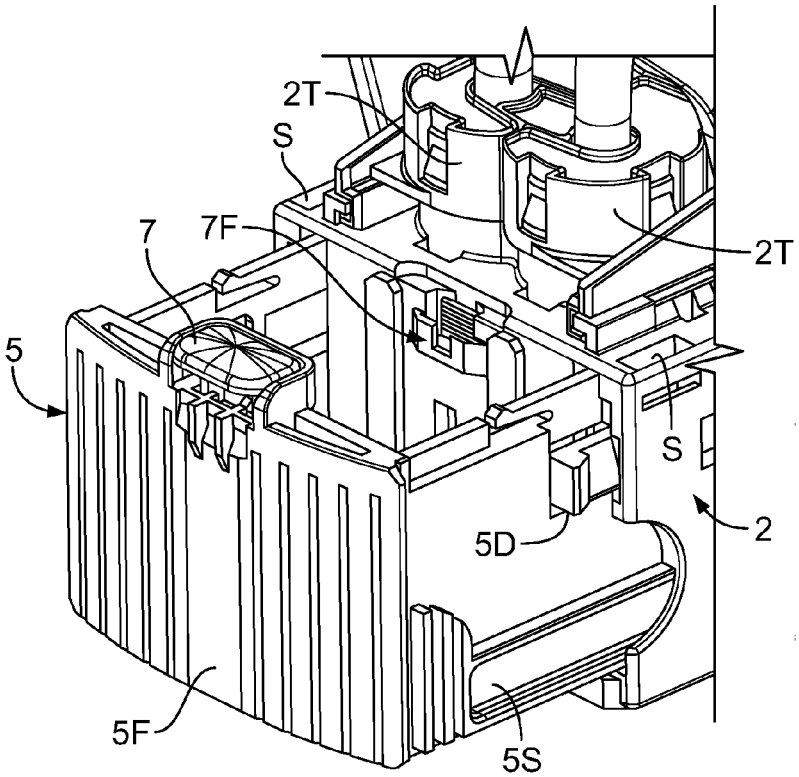
Figure 14:
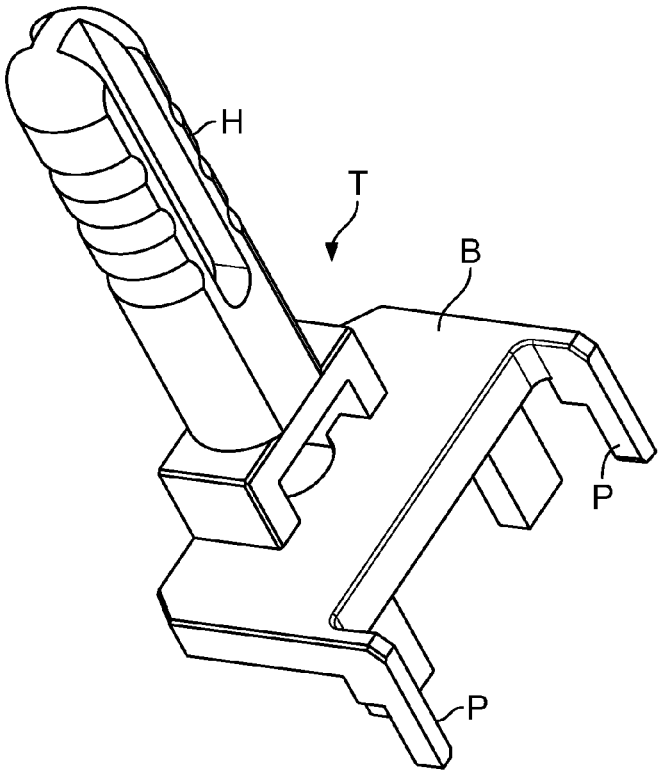

Further features and advantages of the invention will become clear from the following description which is given with reference to the appended drawings which are provided purely by way of non-limiting example and in which:

FIGS. 1A, 1B and 2 are perspective views of the connector according to the invention, respectively in an exploded state, in an assembled state with the two connector elements uncoupled, and in a state in which the two connector elements are coupled, FIGS. 3-6 are side views of the first connector element and of the sliding element in four different operative positions, FIG. 7 is a perspective view of the sliding element, FIG. 8 is an enlarged view of a detail of FIG. 7, FIG. 9 is a partly exploded view of the second connector element, FIG. 10 is an enlarged view of a detail of FIG. 9, FIGS. 11A and 11B are perspective views from above and from below of the first connector element on its own, FIG. 12 is a partial side view of the connector according to the invention, in which a button for securing the connector in the closed state can be seen, FIG. 13 is a perspective view of the detail of FIG. 12, and FIG. 14 is a perspective view of a tool that can be used to release the sliding element and allow it to move into its fully extended position.

In the drawings, reference numeral 1 denotes, as a whole, a high-voltage electrical connector which can be used, for example, for connection to the battery powering an electric traction motor for an electric traction motor vehicle. It should be noted that although the invention is illustrated in this instance with reference to such a specific application, it may nonetheless be used with any other type of connector which has a sliding element for controlling closure of the connector.

The connector 1 comprises a first connector element 2, which can be seen separately in FIGS. 11A and 11B, having a box-like body which is made of plastics materials and downwardly open with an upper wall 2U, a front wall 2F, a rear wall 2R and two side walls 2S. The body of the first connector element 2 further includes a central core 2C defining five prismatic tubular bodies 2T projecting from the upper wall 2U and extending as far as the base of the body of the connector element 2 so as to define a peripheral receptacle 2L between the central core 2C and the walls 2F, 2R, 2S of the body of the connector element 2 (see FIG. 11B). The prismatic tubular elements 2T receive the same number of contacts (not visible in the drawings) of any type known per se with five conductors 3 arranged at the ends thereof. The contacts are not shown in the drawings provided, both because (as mentioned above) they may be of any known type and also because they themselves are not the subject of the present invention.

The connector 1 further comprises a second connector element 4 which can be seen separately in FIG. 9. The connector 4 has a body made of plastics material incorporating a base plate 4B from which a box-like body projects upwardly and includes two spaced, parallel side walls 4S and two spaced, parallel end walls 4E. Prismatic tubular elements 4T which receive the respective electrical contacts of any known type, adapted for coupling to the electrical contacts carried by the first connector element 2 extend upwardly within the space defined by the walls 4S, 4E. The contacts of the element 4 are also not shown in the drawings, both because (as mentioned above) they may be of any known type and also because they themselves are not the subject of the present invention.

As can be seen clearly in FIGS. 1A, 9 and 10, three horizontal pins 4P, on which three rolling elements, specifically three cogs 4W made of metal or plastics material are rotatably mounted, project from the outer face of the two side walls 4S. As can be seen in FIG. 10, each pin 4P has a diametrical slot 4F which defines two resiliently deformable half-pins, of which the head is provided with projections 4G which axially retain the respective cog 4W once is it has been clicked onto the pin 4P. In the preferred embodiment shown in this instance, each cog 4W has a toothed rolling surface.

The substantially tubular body defined by the walls 4S, 4E of the second connector element 4 is slidingly received in the peripheral receptacle 2L of the first connector element 2.

Furthermore, as can be seen in the drawings and, in particular, in FIG. 1, the inner faces of the two side walls 2S of the first connector element slidingly guide the side walls 5S of a substantially U-shaped sliding element 5 with a front wall 5F (see FIG. 7). The sliding element 5 is slidingly mounted between the two side walls 2S of the first connector element 2 between an extended position (for example shown in FIG. 1 and in FIG. 3) and a retracted position (shown in FIG. 2 and in FIG. 6).

As can be seen in FIGS. 7 and 8, the inner surface of each of the two side walls 5S of the sliding element 5 is formed with three grooves 5F, each of which receives a respective cog 4W carried by the second connector element 4. Each groove 5F is downwardly delimited by a generally planar, inclined surface which defines a track 5T for the respective cog 4W. In the preferred embodiment, the generally planar, inclined surface of each track 5T is toothed and cooperates with the toothed rolling surface of the respective cog 4W in such a way that when the sliding element is brought out of the extended position shown in FIG. 1, in which the front wall 5F is spaced from the front wall 2F of the first connector element 2, and into the retracted position shown in FIG. 2, in which the front walls 5F, 2F are drawn together, the tracks 5T act as cam tracks which force the second connector element to be raised until arranged in the state coupled to the first connector element, in which the respective electrical contacts are coupled, whilst the cogs 4W carried by the second connector element 4 are forced to rotate along the tracks 5T in the sliding member 5.

As a result of the pre-arrangement of the rolling elements 4W on the pins 4P of the second connector element 4, the sliding element 5 and the second connector element 4 are engaged with rolling friction, which makes it possible to drastically reduce the force for closing the connector required in order to mutually couple the contacts carried by the two connector elements 2, 4.

Each of the grooves 5C formed in the inner face of the walls 5S of the sliding element 5 is wider than the diameter of the respective cog 4W so as to ensure that each cog 4W rolls on the respective track 5T without contacting the opposite side of the respective groove 5C.

In the specific embodiment illustrated, the movement of the sliding element 5 from its extended position to its withdrawn position for closing the connector is assisted by an actuation lever 6. The lever 6 has a substantially U-shaped plastics material body with a central crossbar 6C which connects two side arms 6S. In the vicinity of their free ends, the side arms 6S have two projecting pins 6A, 6B facing their inner surfaces which engage with respective slots 2A, 2B penetrating the two side walls 2S of the body of the first connector element 2 (see in particular FIGS. 3-6). The slot 2A is curved, whereas the slot 2B is straight and orientated in the direction of movement of the sliding element 5. Furthermore, the pins 6B of the lever 6 project inside the respective walls 2S and engage two respective seats 5P formed in the outer faces of the side walls 5S of the sliding element 5 (see FIG. 7). As a result of this arrangement, the movement of the lever 6 from the position shown in FIG. 3 to the position shown in FIG. 6, through the positions shown in FIGS. 4 and 5, causes the progressive movement of the sliding element 2 from its fully extended position to its fully retracted position.

Of course, in accordance with the invention the prearrangement of a lever of the type illustrated is not essential and is generally only preferred when the force for closing the connector is substantially greater than usual levels. Normally, the prearrangement of the lever is not necessary owing to the reduction in the closure force obtained by the use of the rolling elements 4W.

With reference again to FIGS. 1, 2, 12 and 13, the front wall 5F of the sliding element 5 is provided on its upper edge with a button 7 for securing the connector in the closed state. The button 7 (see FIG. 13) is received in a seat formed in the upper edge of the front wall 5F and is slidingly mounted vertically in said wall between a deactivated, raised position and an activated, lowered position in which it is received in a respective seat 7F formed in the front wall 2F of the first connector element 2.

In order to safeguard against the undesired opening of the connector, teeth 5D carrying resilient arms (one of which can be seen in FIGS. 1 and 13) are formed in the side walls 5S of the sliding element and, once the sliding element 5 has been brought into the retracted state, prevent it from returning to the fully extended position by engagement with stop surfaces (not shown in the drawings) formed in the side walls 2S of the first connector element 2. If it is desired to move the sliding element 5 into its fully extended position, it is necessary to use a tool T (shown in FIG. 14) having a grip H which extends from a base plate B which can be positioned above the sliding element 5 when said sliding element is only partly extended, the teeth 5D contacting said stop surfaces. In this state, two prismatic pegs P projecting downwardly from the base plate B (see FIG. 14) are received in respective seats S (FIGS. 1B and 13) in the body 2 and engage with the outwardly turned faces of the resilient arms carrying the teeth 5D so as to deform them inwardly and allow the sliding element to move into the end position shown in FIG. 1B, corresponding to the connector being open, defined by the engagement of the pins 6B carried by the lever 6 against the ends of the respective slots 2B formed in the body of the first connector element 2.

Naturally, the principle of the invention remaining the same, the forms of embodiment and details of construction may be varied widely with respect to those described and illustrated, which have been given purely by way of example, without thereby departing from the scope of the present invention.

The invention claimed is:

1. Electrical connector comprising a first connector element and a second connector element carrying respective contacts and interconnected so as to be movable, along a coupling direction, between an uncoupled state and a coupled state, said connector further comprising a sliding element mounted in the first connector element so as to be slidable, in a direction orthogonal to said direction of coupling, between an extended position and a retracted position in said first connector element, said sliding element having one or more cam tracks, each engaged by an element of the second connector element in such a way that a movement of the sliding element from the extended position thereof to the retracted position thereof in said first connector element causes the second connector element to move into the coupled state, wherein each cam follower element of the second connector element engages the respective cam track via a rolling element mounted rotatably on said cam follower element.

2. Electrical connector according to claim 1, wherein each rolling element and the respective track have cooperating knurled or toothed surfaces.

3. Electrical connector according to claim 1, wherein an actuation lever is oscillatingly mounted on the body of said first connector element and has a pin connected in an articulated manner to the sliding element and slidingly guided on the body of the first connector element.

4. Electrical connector according to claim 1, wherein said sliding element is provided with a button adapted to engage the body of the first connector element when the sliding element is retracted inside the first connector element so as to secure the connector in the closed state.

5. Electrical connector according to claim 1, wherein the sliding element has at least one tooth carried by a resilient arm which prevents the sliding element from moving into its fully extended position once the sliding element has been brought into its fully retracted position, and in that a tool is associated with said connector and is provided with a peg which can be received in a seat in the body of the first connector element so as to move said resilient arm into an inoperative position and to thus allow the sliding element to move into its fully extended position.

6. Electrical connector according to claim 1, wherein each of said elements is a pin having a diametrical slot which divides the body of the pin into two resilient half-pins equipped with end projections for allowing each rolling element to be clicked onto the respective pin.

* * * * *